US005164236A

United States Patent [19]

Schmid

[11] Patent Number: 5,164,236

[45] Date of Patent: Nov. 17, 1992

[54] OPENING ROLLER FOR AN OPEN-END SPINNING ARRANGEMENT

[75] Inventor: Friedbert Schmid, Bad Überkingen, Fed. Rep. of Germany

[73] Assignee: Wilhelm Stahlecker GmbH, Fed. Rep. of Germany

[21] Appl. No.: 662,830

[22] Filed: Mar. 1, 1991

[30] Foreign Application Priority Data

Mar. 17, 1990 [DE] Fed. Rep. of Germany ..... 4008637

[51] Int. Cl.[5] ..... B32B 1/08; D01H 4/00

[52] U.S. Cl. ..... 428/344; 428/698; 428/699; 428/469; 57/404; 57/408; 19/112

[58] Field of Search ..... 57/404, 408; 19/112; 428/34.4, 698, 699, 469; 427/129

[56] References Cited

U.S. PATENT DOCUMENTS

| | | | |
|---|---|---|---|
| 4,805,395 | 2/1989 | Stahlecker et al. | 19/112 |
| 4,858,275 | 8/1989 | Stahlecker et al. | 19/112 |
| 4,859,494 | 8/1989 | Lancsek | 427/304 |
| 4,882,812 | 11/1989 | Fetzer et al. | 19/112 |
| 5,006,367 | 4/1991 | Lancsek | 427/304 |

FOREIGN PATENT DOCUMENTS 3543428 6/1987 Fed. Rep. of Germany .

*Primary Examiner*—Ellis P. Robinson
*Assistant Examiner*—Charles R. Nold
*Attorney, Agent, or Firm*—Evenson, Wands, Edwards, Lenahan & McKeown

[57] ABSTRACT

For an opening roller of an open-end spinning arrangement, a coating is provided for the mounting made of needles or teeth and the circumferential surface of the roller, which coating consists of a metal carbide coating and a thin nickel layer applied over it.

6 Claims, 1 Drawing Sheet

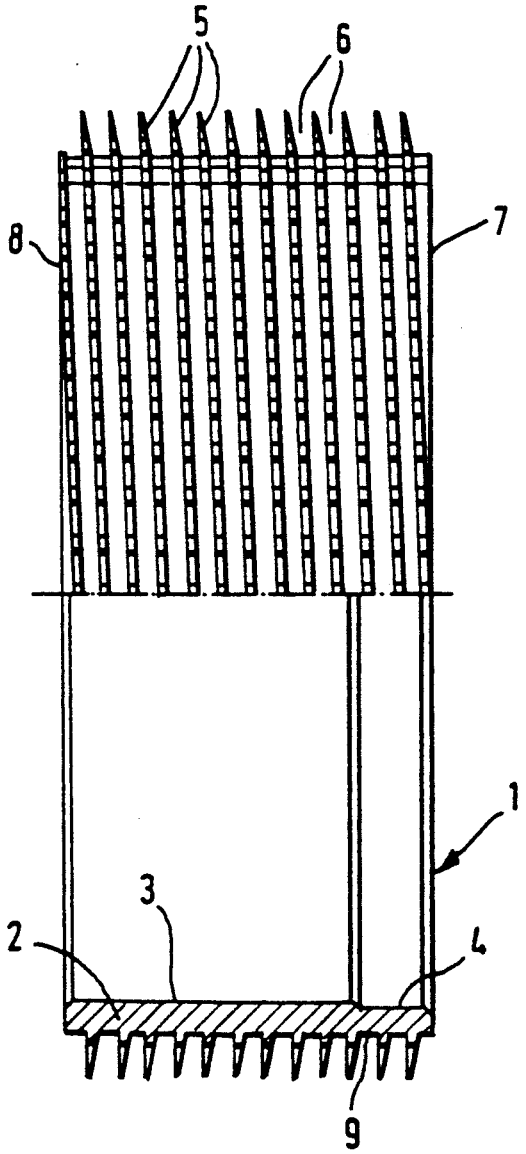
5
6
8
7
1
3
2
4
9

OPENING ROLLER FOR AN OPEN-END SPINNING ARRANGEMENT

BACKGROUND AND SUMMARY OF THE INVENTION

The invention relates to an opening roller for an open-end spinning arrangement having a mounting of needles or teeth provided on the circumferential surface, the circumferential surface and the mounting being provided with a metal carbide coating, to which another coating is applied.

It is known from German Patent Document DE-A 35 43 428 that relatively high stress occurs at the mounting in the case of opening rollers of the initially mentioned type, particularly if synthetic-fiber material must be processed. It is also known that, for this reason, a coating of the mounting and of the circumferential surface is carried out which form a protection against wear. It is also known that, although the previously known coatings result in an increased protection against wear, they have the disadvantage that they have a negative influence on the fiber material. In order to avoid damage to the fiber material, it is provided in the known construction that a synthetic material is embedded by means of a coating that follows the first coating. This synthetic material must not have any influence on the protection against wear but only has the purpose of providing the coating with a smooth surface. However, this construction was also not completely satisfactory in practice. Although it was found that the individual fibers proper are not damaged and shortened extensively, small particles are detached from the fibers during the processing, particularly of synthetic fibers. These particles appear as dust which is deposited in the spinning rotor. This dust will then relatively rapidly lead to a disadvantageous change of the spinning characteristics.

An object of the invention is to provide an opening roller of the initially mentioned type which has extensive protection against wear and also largely prevents the formation of fine dust.

This object is achieved according to the invention by providing that a thin nickel layer is provided over the metal carbide coating.

Surprisingly, it was found that by means of such a thin nickel layer over the metal carbide coating, the protection against wear is virtually not reduced, but that the dust formation is largely excluded. One reason is probably the fact that the nickel layer results in a smoothing of the surface so that the fiber material to be processed suffers no "rubbing-off" which would appear as dust. Although nickel per se is not very resistant to wear, it was found that the coating as a whole has a high resistance to wear. The possible reason may be that, after an initial wear of the outermost nickel layer, the metal carbide layer appears in the form of islands and then determines the overall resistance of the surface to wear. The two constituents of the coating therefore fulfill different functions, specifically a protection against wear by means of the metal carbide coating, on the one hand, and a careful treatment of the fibers by means of the nickel coating, on the other hand.

In a further development of the invention, a coating method is provided in which first the circumferential surface and the mounting are provided with a metal carbide coating by means of plasma spraying, and the metal carbide coating is subsequently chemically after-nickeled. It was found that metal carbides can be chemically after-nickeled.

Other objects, advantages and novel features of the present invention will become apparent from the following detailed description of the invention when considered in conjunction with the accompanying drawings.

BRIEF DESCRIPTION OF THE DRAWINGS

The single drawing figure illustrates a ring mounting 1 for an opening roller, half of which is shown as a plan view and the other half as an axial sectional view.

DETAILED DESCRIPTION OF THE DRAWINGS

The ring mounting 1 comprises a sleeve 2 which is pushed by means of its interior surface 3 onto a basic opening roller body, as known in principle on the basis of the German Patent Document DE-A 35 43 428. The interior surface 3 is provided with a ring-groove-type indentation 4 in the area of a front end in order to exclude a sliding-on of the ring mounting 1 on the wrong side.

On its circumferential surface 9, the ring mounting 1 is provided with a mounting of teeth 5 which are arranged on the circumferential surface 9 in helically surrounding rows and which leave channels 6 between them. In the shown embodiment, the ring mounting 1 is made of steel into which the teeth 5 are ground. In alternative embodiments, it is provided that the teeth are produced in a known manner as a saw-tooth wire wound onto the circumferential surface 9. In another modification, it is provided that, instead of the teeth 5, needles are arranged in a corresponding manner.

In the illustrated embodiment, the ring mounting 1 is not provided with collars on its front surfaces 7, 8, which bound the mounting toward the outside in the axial as well as in the radial direction. Collars of this type are mounted on a fastening device on a basic body, onto which the ring mounting 1 is slid. These collars have the object of protecting the mounting from damage during transport.

The whole circumferential surface 9, that is, the teeth 5 and the channels 6, are provided with a coating which causes a protection against wear and which is constructed such that a treatment of the fiber material to be processed takes place that is as careful as possible and during which no rubbing-off takes place which forms dust. The circumferential surfaces 9, that is, the teeth 5 and the channels 6, are first provided with a tungsten carbide coating of a thickness of from 0.03 mm to 0.04 mm. The thickness of this tungsten carbide coating is limited by the fact that the coating should not change the contour of the teeth 5. This coating is applied in a known manner by plasma spraying.

After the application of the tungsten carbide coating, the ring mounting 1, in the area of its circumferential surface 9, that is, in the area of the teeth 5 and the channels 6, is after-nickeled in a chemical nickel bath. In this case, a nickel coating is applied to the tungsten carbide layer of the teeth 5 and of the channels 6 which has a layer thickness of less than 0.01 mm, and preferably a layer thickness in the order of 0.003 mm to 0.005 mm. This after-nickeling results in a smoothing of the surface.

It was found that, for the application of the nickel layer, the metal carbide surface must be very compact and fine-grained. One hindrance is that the plasma spraying is difficult with very fine dust particles. Tungsten carbide was found to be very advantageous in this respect because, on the one hand, it results in a compact structure with a relatively fine grain and because, on the other hand, it also results in very good adhesion, particularly on the steel.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An opening roller for an open-end spinning arrangement comprising needles or teeth on the circumferential surface, a metal carbide coating on the circumferential surface and the needles and the teeth and a thin nickel layer provided over the metal carbide coating.

2. An opening roller according to claim 1, wherein the nickel layer coating has a layer thickness of no more than 0.01 mm.

3. An opening roller according to claim 2, wherein said nickel layer has a layer thickness of between 0.003 mm to 0.005 mm.

4. An opening roller according to claim 1, wherein a tungsten carbide layer coating of from 0.03 mm to 0.04 mm is provided under the nickel layer coating as the metal carbide coating.

5. An opening roller according to claim 2, wherein a tungsten carbide layer coating of from 0.03 mm to 0.04 mm is provided under the nickel layer coating as the metal carbide coating.

6. An opening roller according to claim 3, wherein a tungsten carbide layer coating of from 0.03 mm to 0.04 mm is provided under the nickel layer coating as the metal carbide coating.

* * * * *